United States Patent [19]

Box

[11] 4,190,172

[45] Feb. 26, 1980

[54] BEVERAGE BOTTLE CASE

[76] Inventor: Theodor M. Box, 1108 Aileen Rd., Brielle, N.J. 08730

[21] Appl. No.: 691,627

[22] Filed: Jun. 1, 1976

[51] Int. Cl.[2] ..... B65D 1/24; B65D 21/00

[52] U.S. Cl. ..... 220/21; 206/511

[58] Field of Search ..... 220/21, 22, 22.1, 22.2, 220/22.3, 22.5; 206/503, 505, 509, 515, 511

[56] References Cited

U.S. PATENT DOCUMENTS

| | | | |
|---|---|---|---|
| 3,129,838 | 4/1964 | Wormer | 220/21 |
| 3,200,988 | 8/1965 | DeChelbor | 220/21 X |
| 3,353,704 | 11/1967 | Belcher et al. | 220/21 |
| 3,628,684 | 12/1971 | Sere | 220/21 |
| 3,656,650 | 4/1972 | Frater | 220/22.3 |
| 3,791,549 | 2/1974 | Delbrouck | 220/21 |

*Primary Examiner*—Steven M. Pollard

*Attorney, Agent, or Firm*—Kenyon & Kenyon

[57] ABSTRACT

An injection molded high impact plastic beverage transport case is disclosed having interior partitions defining individual compartments for receiving beverage containers, said partitions being releasably joined to associated interior portions of the beverage case and removable therefrom to provide an open stowage compartment defined by the outer walls of the case to accommodate the stowage and transport of bulk materials and the like. Outwardly disposed saw-toothed vertical ribs are provided on the outer side walls of the case for frictional gripping by loading and unloading devices. The bottom wall of the case is provided on its outer surface with radial stacking ribs and oriented to provide stacking recesses adapted to receive the tops of bottles stored in a similar case immediately below in a stack of cases.

2 Claims, 6 Drawing Figures

BEVERAGE BOTTLE CASE

BACKGROUND OF THE INVENTION

Various structural designs for beverage cases are well-known in the art. Representative prior art U.S. Pat. Nos. are 3,120,322; 3,092,284; 3,186,586; 3,282,462; 3,349,943; 3,391,814; 3,391,815; 3,568,879.

In the beverage transport cases of the prior art it has been a practice to provide fixed interior compartmentation for the storage of a given size of beverage container. For example, separate cases have been required for 12 ounce, 24 ounce, 32 ounce and 64 ounce soft drink beverage containers. With such prior containers it was an inherent characteristic for the most part that each case had no other utility and could not be used for the transport of anything other than specific containers for which they were constructed.

The need for a beverage case having broader versatility than the cases of the prior art described above has long been desired and as can be seen below the present invention has achieved that end.

BRIEF SUMMARY OF THE INVENTION

A plastic carrying case for beverages and the like is provided, constructed of integrally molded high impact synthetic material, and having side and bottom walls. The side and end walls are formed at the upper edges with a pair of spaced outwardly projecting flanges to provide a reinforced stacking rim portion around the periphery thereof. Adjacent each corner of the side walls is an outwardly disposed vertical rib of saw-toothed configuration. The side and end walls are further provided at their lower edges with an outwardly protecting stacking flange. The bottom wall has a substantially planer outer surface provided with a longitudinal rib and a plurality of transverse ribs projecting downwardly therefrom to define areas corresponding to the subcompartmentation for which the interior of the case is adapted. Radially inwardly projecting ribs are disposed in each of said defined areas terminating short of the geometric center thereof and having angular inner ends providing stacking ramps for the tops of beverage containers with which said bottom case comes into contact with in a vertical stack of similar cases.

The interior of said case is provided with an outwardly projecting rib structure corresponding to the outer bottom rib structure just defined with the exception that the radial ribs extend all the way to a common central junction, such radial network providing bottom support for containers disposed within the case as well as structural reinforcement for the case bottom. The inner side walls of the case are each provided with a plurality of vertical rib and slot portions and the inner end walls are each provided with at least one pair of similarly arranged vertical rib and slot portions. Such slotted members are adapted to receive egg crate- or honeycomb-type partitions, the outer edges of which are slideably received into respective of said slotted portions. Said partitions have a plurality bottom mounting lugs or tabs engaging adjacent portions of said upwardly extending longitudinal and transverse ribs on the inner bottom of the case.

Other objects which are features of the invention will become apparent in the following description.

DESCRIPTION OF THE PREFERRED EMBODIMENT

Figure 1:
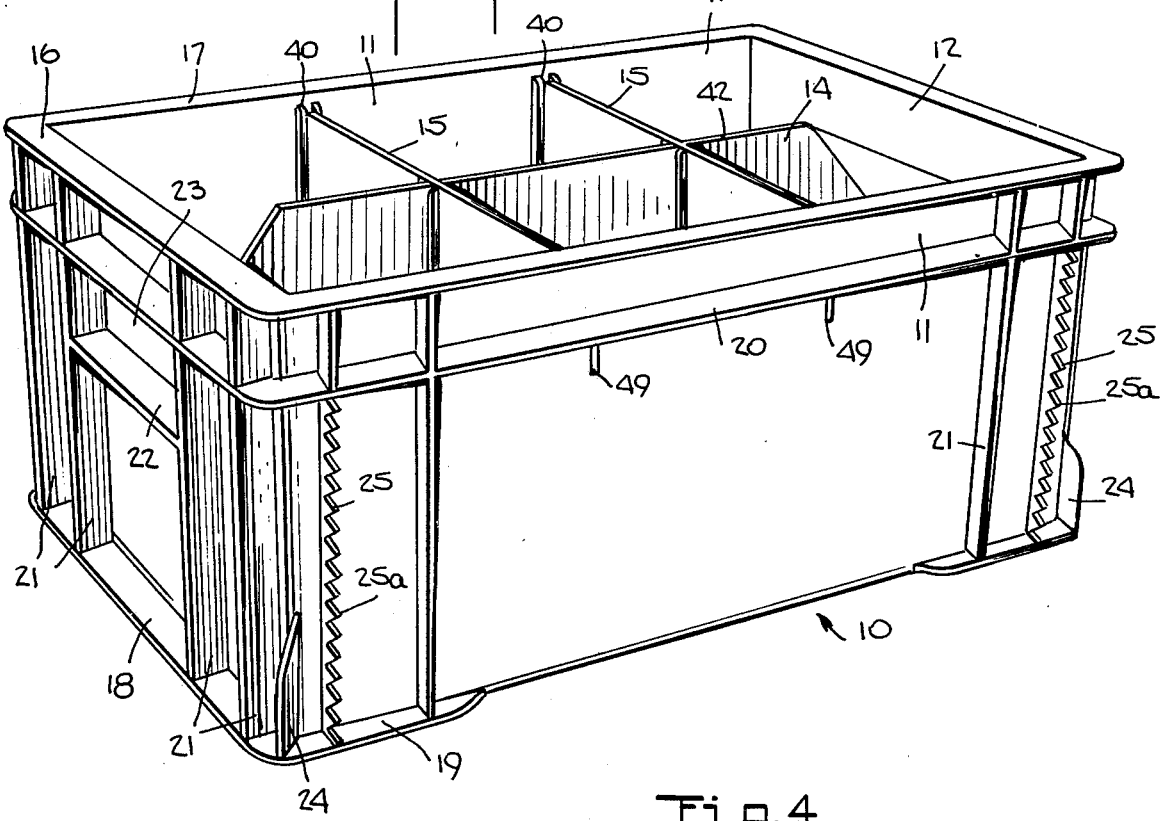
FIG. 1 is an isometric view of a case embodying the principles of the present invention.
Figure 4:
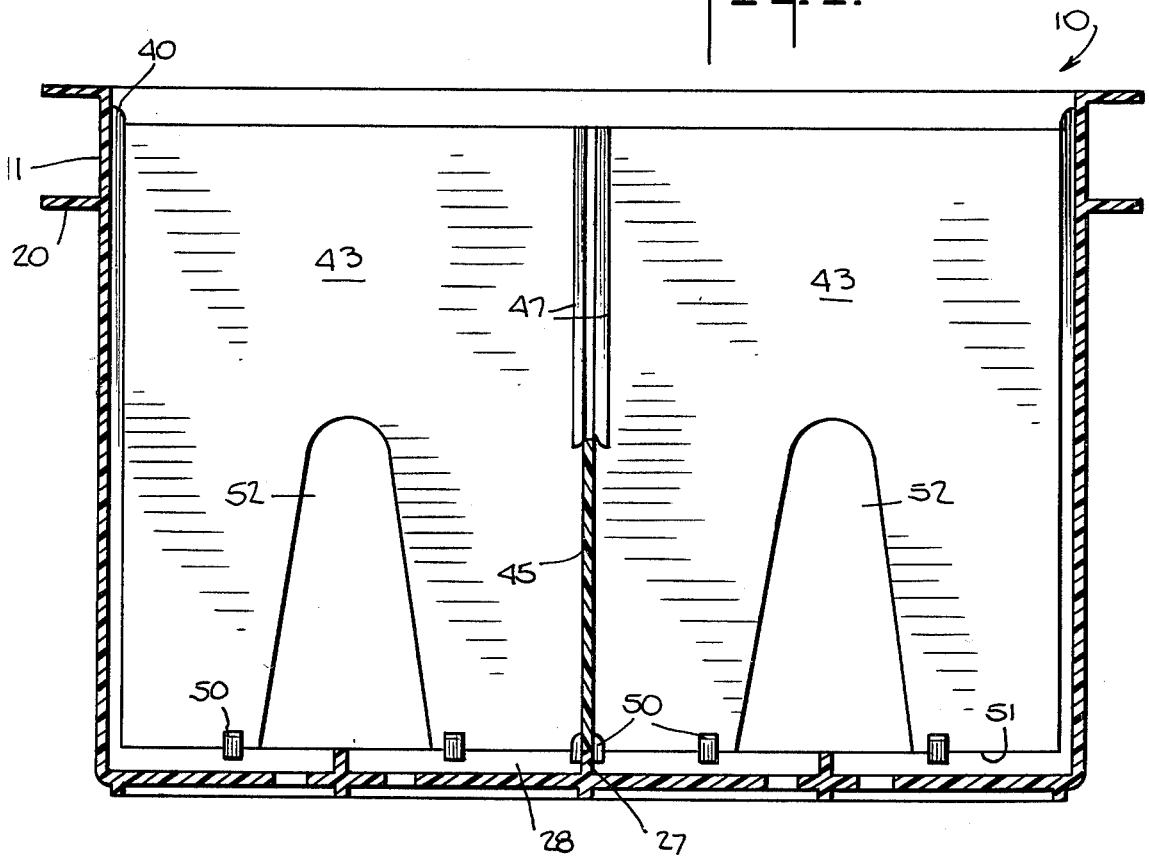
FIG. 4 is an end elevation taken along lines 4—4 of FIG. 3.

Referring now to the drawings, FIG. 1 shows a beverage case designated generally by reference numeral 10 having respective pairs of side walls 11 and end walls 12 and bottom wall 13 (see also FIG. 3) defining an outer case structure. Inner compartmentation is provided by centrally disposed longitudinal partition 14 and transverse partitions 15 engaged therewith.

The upper and lower edges of the case are provided with outwardly extending stacking flanges. Upper stacking flange 16 extends around the periphery of upper edge 17 and discontinuous stacking flange 18 is provided at the bottom edge 19. Reinforcing flange 20, being substantially similar in shape to upper flange 16, is provided at a spaced position below the latter flange as shown in FIG. 1. A plurality of vertical reinforcing flanges 21 are symetrically disposed on the ends and sides of the case as shown. Additional horizontal flange members 22 are provided at the ends of the case. Between horizontal flanges 22 and adjacent portions of flange 20 are disposed hand holes 23.

Each bottom corner of the case is provided with reinforcing fins 24 and adjacent thereto are respective vertical rib members 25 having outwardly disposed saw-toothed edges **25*a*** adapted to provide enhanced frictional contacting surfaces for the gripping devices of loading and unloading equipment (not shown).

Figure 2:
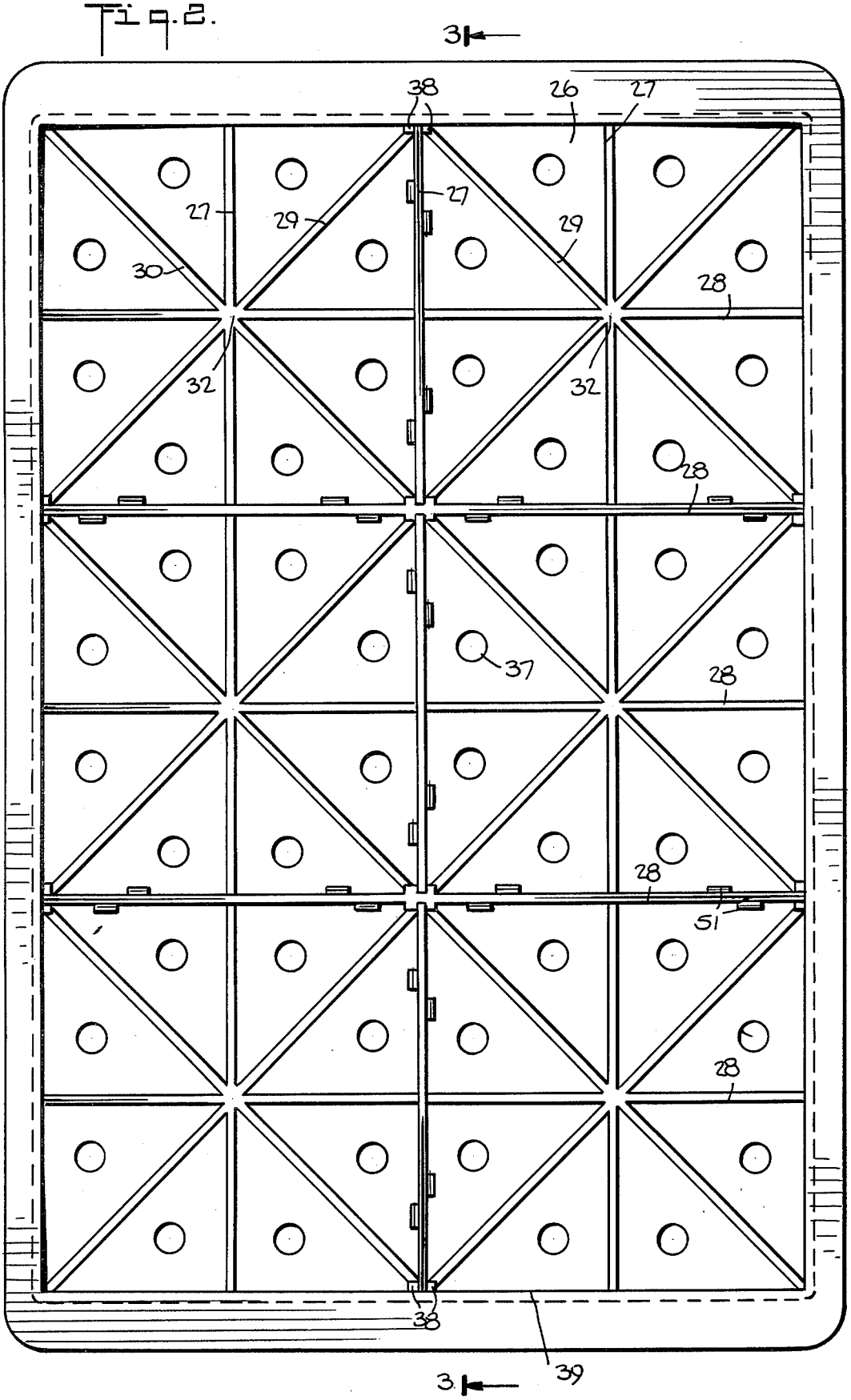
FIG. 2 is an enlarged top plan view of the case.

As shown in FIG. 2, inner bottom surface 26 is provided with a rib network comprised of a plurality of longitudinal rib members 27 and transverse rib members 28 defining a plurality of similarly shaped rectangular areas. Extending diagonally through said defined rectangular areas are diagonal rib members 29 and 30 that divide all of the square areas into triangular sections as shown. The entire rib network just described provides not only bottom structural reinforcement for the case but also bottom support surfaces for beverage containers stored within the case as will be described further hereinafter.

Figure 6:
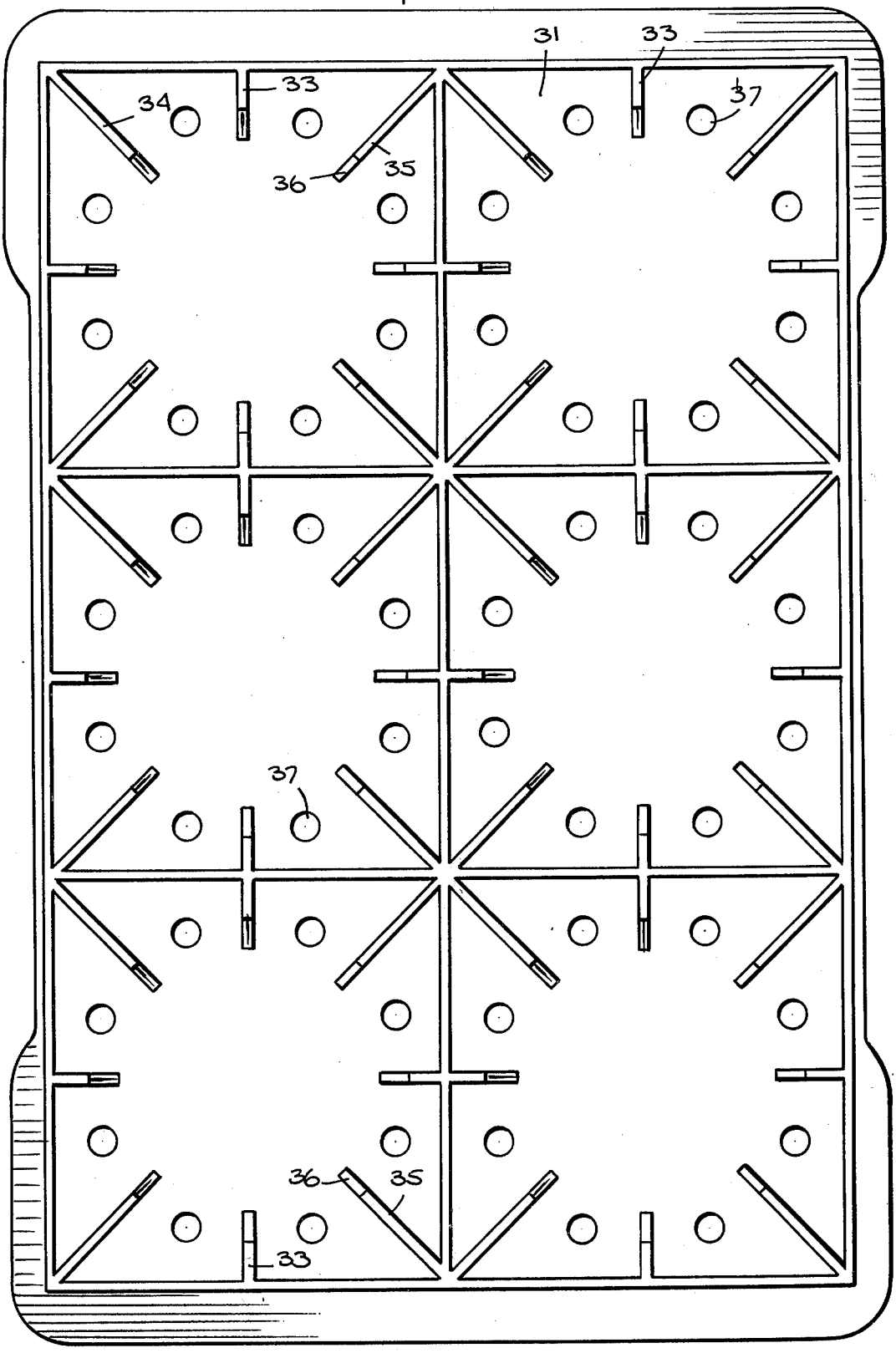
FIG. 6 is an enlarged bottom plan view of the case.

As shown in FIG. 6, outer bottom surface 31 is provided with a similar rib network that extends downwardly below said bottom surface 31. As can be seen, whereas the inner bottom network has central junction points 32 at which longitudinal rib members 27 intersect with diagonal rib members 29, 30 the outer bottom rib structure network has no such junction points, the corresponding longitudinal rib members 33 and diagonal rib members 34, 35 being terminated short of such an intersection point in angular or wedge shaped ramp portions 36. A plurality of circularly disposed drainage holes 37 are provided in case bottom 13.

Figure 3:
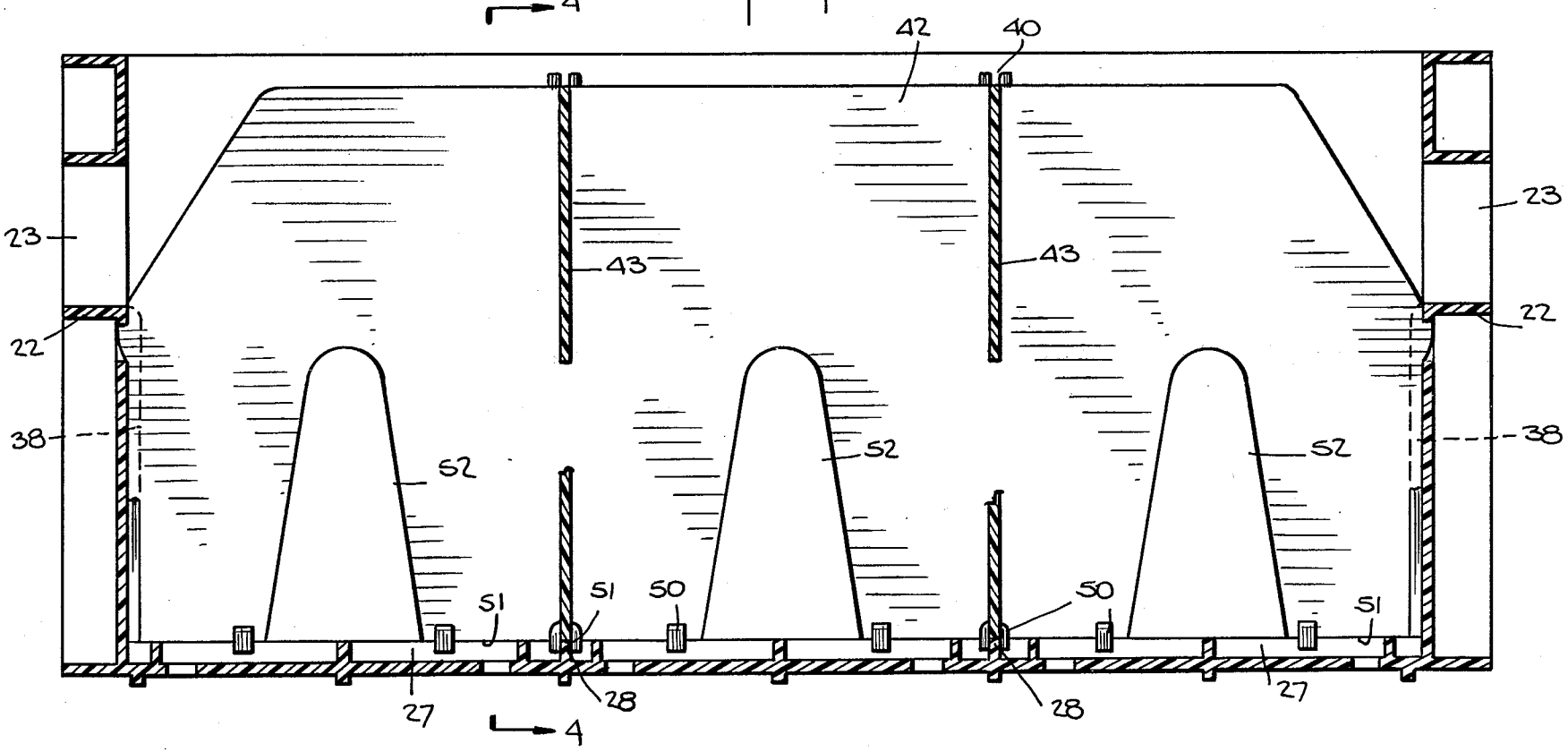
FIG. 3 is a side elevation taken along lines 3—3 of FIG. 2.
Figure 5:
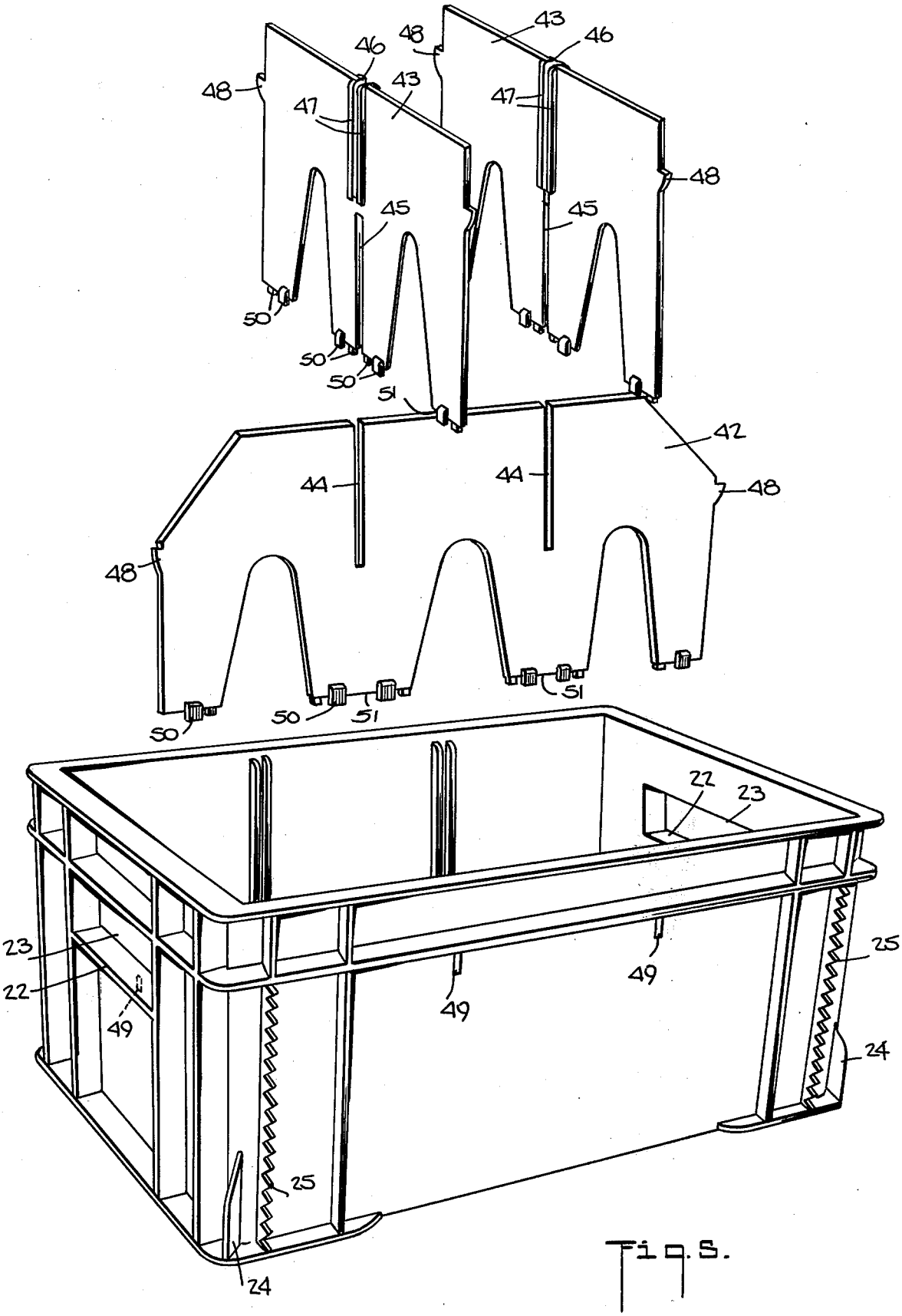
FIG. 5 is an exploded isometric view of the case shown in FIG. 2.

A pair of centrally disposed spaced rib members 38 are provided on the inner surface 39 of each end wall 12 extending from the bottom of hand holes 23 to or near inner bottom surface 26 (see FIGS. 2, 3). Similarly disposed pairs of spaced rib members 40 are located on inner surface 41 of side walls 11. All of said pairs of rib members 38, 40 provide mounting slots for interfitting partition members 42, 43 that define inner container receiving compartments as shown in FIGS. 1, 5. Said partitions 42, 43 have complementary slotted portions 44, 45 that intermesh with one another in egg crate fashion as shown. Transverse partitions 43 have upper slotted portions 46 defined by spaced rib portions 47 for receiving slotted portions 44 of partition 42. Outwardly extending ear members 48 on partition members 42 and 43 engaged mounting slots 49 in the side and end walls of the case when assembled. In addition, mounting lugs or tabs 50 along the bottom edges 51 of partitions releasably engage the inner bottom rib network members 27, 28 in the assembled position. Partition members 42, 43 have cutaway portions 52.

With the partitions 42, 43 assembled within case 10 as shown in FIG. 2 subcompartments are provided for the receipt of appropriately dimensioned beverage containers (not shown). With the partitions 42, 43 removed from the case, the case has utility for the storage and transport of objects and materials other than beverage containers. It is also contemplated that a plurality of vertical rib assemblies 38, 40 can be employed to mount other partition arrangements for different sized beverage containers so that the case would not be permanently confined to the receipt and transport of only one sized container.

The bottom rib configuration shown in FIG. 6 has the same general arrangement and functional utility for stacking as that shown in prior art U.S. Pat. No. 3,349,943 except that the present improved rib network, having more radial ribs, is more efficient in retaining and removing an upper case from a lower case, is structurally stronger and more resistant to jamming and breakage of containers.

Another novel feature of the present invention is that the partitions 42, 43 are not only manually removable from the case, but upon removal are capable of disassembly so that they can be stored flat within the case against the bottom thereof when the case is adjusted for the transport of other goods than the beverage containers. In this manner the partitions may be kept with the case at all times and loss thereof avoided.

The materials of construction of all parts may be of any conventional plastic as described, such as high impact polystyrene, polyethylene, polypropylene, etc. While one embodiment of the invention has been shown and described herein it is to be understood that changes and additions may be made by those skilled in the art without departing from the scope and spirit of the invention.

I claim:

1. In a beverage transport case of the type adapted for stacking with other similar cases and having side, end and bottom walls and upper and lower stacking flanges, and further including inner beverage container-receiving compartmentation, and bottom stacking recesses adapted for engagement with the tops of beverage containers in a case below such case in a stack, said case being of the type wherein the top portions of stored beverage containers extend upwardly beyond the top edge of said case, the improvement comprising inner compartmentation partitions releasably engaged with and disposed within said case and being removable therefrom to provide an open interior of said case for the storage of other goods, vertical slotted portions on the inner surfaces of said side and end walls adapted to slideably receive and mount associated portions of said partitions to provide subcompartmentation within said case, said partitions being capable of disassembly from one another and stowable within said case against the inner bottom thereof, said slotted portions including locking apertures extending through said side and end walls and complementary shaped projections on said partitions releasably engaging said apertures in assembled condition within said case, a raised rectangular reinforcing rib network disposed on the inner bottom of said case having a plurality of spaced parallel longitudinal ribs extending from end to end of the case and a plurality of spaced parallel transverse ribs extending from side to side of the case and intersecting said longitudinal ribs, said network including a plurality of diagonal ribs extending through the corners of said rectangular network to divide said inner bottom into a plurality of congruent right isosceles triangular areas and provide raised bottom support means for containers disposed within said case, said partitions having a plurality of bottom tabs releasably engaging said ribs to lock them in position in assembled condition, and a plurality of exterior vertical flanges on said case having outer sawtoothed edge configurations to provide enhanced frictional contact of said case with handling equipment.

2. In the case of claim 1, a raised rectangular rib network on the outer bottom of said case defining rectangular areas corresponding to the inner compartmentation and including radially inwardly extending ribs from each corner and each side of each said area and terminating short of the geometric point of intersection in angular ramps to provide stacking and removal assistance of said case with a similar case containing beverage containers stacked below it.

* * * * *